US005653557A

United States Patent [19]

Gruber

[11] Patent Number: 5,653,557

[45] Date of Patent: Aug. 5, 1997

[54] INJECTION TUBE AND METHOD FOR PLACING A GROUND ANCHOR

[75] Inventor: Heinz Gruber, Seesen/Rhüden, Germany

[73] Assignee: GD-Anker GmbH, Seesen-Rhueden, Germany

[21] Appl. No.: 988,970

[22] PCT Filed: May 30, 1992

[86] PCT No.: PCT/EP92/01208

§ 371 Date: Nov. 22, 1993

§ 102(e) Date: Nov. 22, 1993

[87] PCT Pub. No.: WO93/01363

PCT Pub. Date: Jan. 21, 1993

[30] Foreign Application Priority Data

Jul. 2, 1991 [DE] Germany ..... 41 21 851.5
Aug. 24, 1991 [DE] Germany ..... 41 28 154.3

[51] Int. Cl.[6] ..... E21D 20/00

[52] U.S. Cl. ..... 405/259.5; 405/259.1; 405/269

[58] Field of Search ..... 405/259.4, 269, 405/259.6, 259.1, 259.5, 259.2, 259.3

[56] References Cited

U.S. PATENT DOCUMENTS

| | | | |
|---|---|---|---|
| 3,869,869 | 3/1975 | Pao Chen . | |
| 3,978,674 | 9/1976 | Herbst | 405/259.5 |
| 3,994,138 | 11/1976 | Herbst . | |
| 4,362,440 | 12/1982 | Glaesmann et al. | 405/259.5 X |
| 4,946,314 | 8/1990 | Gruber | 405/259.5 |

FOREIGN PATENT DOCUMENTS

| | | | |
|---|---|---|---|
| 361857 | 4/1981 | Austria . | |
| 0398838 | 11/1990 | European Pat. Off. . | |
| 2306307 | 10/1976 | France . | |
| 719255 | 4/1942 | Germany . | |
| 2133593 | 7/1973 | Germany | 405/259.5 |
| 207473 | 2/1984 | Germany | 405/259.1 |
| 3400182 | 7/1989 | Germany . | |
| 3813347 | 11/1989 | Germany . | |
| 9004177 | 6/1990 | Germany . | |
| 3724165 | 6/1990 | Germany . | |
| 14270-79 | 9/1988 | U.S.S.R. | 405/259.5 |
| 790483 | 2/1958 | United Kingdom | 405/259.5 |
| 1156673 | 7/1969 | United Kingdom . | |

OTHER PUBLICATIONS

P & V Mining & Engineering) Limited, "Riploy, extension rod equipment", Sheffield, England, 1971. Whole Brochure.

*Primary Examiner*—Tamara L. Graysay
*Assistant Examiner*—Frederick Lagman
*Attorney, Agent, or Firm*—Michael J. Striker

[57] ABSTRACT

An injection bore anchor for use with rock having particularly low cohesive properties has at least two injection valves arranged in the front region of the injection bore anchor and formed as non-return valves so that it is possible for the grout suspension issuing from a longitudinal channel running through the injection bore anchor to flow out but not the reverse. In order to place the injection bore anchor, the injection bore anchor is initially used as a bore rod, wherein a flushing fluid is guided through a longitudinal channel and the bores in the region of a bore-crown. Subsequently, a grout suspension is introduced through the longitudinal channel into the bore hole for filling the bore hole, wherein subsequently the residual grout suspension located within the channel is displaced as far as the region of the bore-crown by a displacement body introduced into the channel. By a grout suspension being introduced again after the initial setting of the grout suspension in the bore hole and the rout suspension now flowing out due to the injection valves, exerting a cracking open effect on the grout located here and/or penetrating in the still existing cracks and gaps, the bore hole in the region of the bore hole bottom and the surrounding rock is expanded and thus the size of the region penetrated by the grout is considerably increased, so that it is possible to secure reliably the position of the injection bore anchor in the surrounding rock.

26 Claims, 3 Drawing Sheets

INJECTION TUBE AND METHOD FOR PLACING A GROUND ANCHOR

BACKGROUND OF THE INVENTION

The present invention relates to an injection tube and in particular to such an injection tube which has at least one tube section provided with a continuously profiled contour and a central longitudinal channel extending through the tube section.

The invention also relates to a method of placing a ground anchor using an injection bore anchor of the above mentioned type, which includes the steps of producing a bore using a suitable flushing medium and introducing into the bore a self-hardening medium through a longitudinal channel on the injection bore anchor and the outlet bores of the longitudinal channel.

Injection bore anchors as such are known. They are structurally substantially equivalent to bore rods and/or injection tubes which, once the bore has been produced, can be used immediately as ground anchors and consequently remain as a lost tool within the bore hole.

An injection bore anchor is for example known from DE 37 24 165 C2. This known injection bore anchor comprises at least one anchor rod section which is provided with an outer thread over its entire length and a plate-shaped bore-crown which is provided with cutting edges and which radially overhangs the anchor rod section and is welded on to the end of the anchor rod section facing the bore hole bottom. A longitudinal channel which runs axially along the anchor rod section issues in the region of the bore-crown in an axial flushing bore, wherein transverse bores for flushing purposes are provided in a region directly adjacent to the bore-crown. Such an injection bore anchor is fundamentally suitable for producing bores and for the subsequent placing of ground anchors, wherein initially a bore is produced using a suitable flushing medium which emerges by way of the said flushing bore of the bore head and the said transfer bores. The flushing medium picks up the rocks which have been released as a result of the boring operation and flushes out the rocks in the direction of the bore hole outlet. Subsequently, the longitudinal channel is used in conjunction with the transverse bores for the purpose of introducing a self-hardening medium, e.g. a grout suspension, which enters in the region of the bore bead in the annular space between the outer side of the anchor rod section and the inner side of the bore hole and subsequently continuously fills the longitudinal channel from the bore hole bottom as far as the outlet of the longitudinal channel. During this filling operation, remaining cracks and crevices in the individual layers of rock are filled and in this way a reliable connection is produced between the ground anchor and the ground, this connection being further improved by means of the thread extending across the outer side of the anchor rod section.

Moreover, screw-on bore heads for bore rods and/or bore anchors are known from the brochure "Riploy, extension rod equipment", P & V (Mining & Engineering) Limited, Sheffield, England, 1971 as well as from DE 34 00 182 C2.

Ground anchors are used in tunnel construction and tunnelling for the purpose of stabilising cavity walls and in addition to this are also used to provide suspension safety devices. These ground anchors function substantially by producing a connection between the successive ground layers in the longitudinal direction of the anchor. The stabilising operation is particularly difficult in all cases where the layers to be connected to each other are regarded as having low cohesive properties, so that special measures are constantly necessary to produce a reliable anchorage.

SUMMARY OF THE INVENTION

Accordingly, it is an object of the present invention to provide an injection tube and a method of placing a ground anchor, which avoids the disadvantages of the prior art.

More particularly, it is an object of the present invention to provide an injection tube in particular with respect to being used in rock, which has extremely low cohesive properties.

In keeping with these objects and with others which will become apparent hereinafter, one feature of the present invention resides, briefly stated, in an injection tube having at least one tube section provided with a continuously profiled contour and a central longitudinal channel extending through the tube section, in which in accordance with the present invention the tube section is provided with at least one injection valve which renders a flow from the longitudinal channel possible, and furthermore the injection valve is formed as a non-return valve which impedes a return flow in the direction of the longitudinal channel.

Accordingly, the invention resides in the fact that the tube section is fitted with a non-return valve, which allows the flow from the central longitudinal channel but blocks any return flow. This non-return valve can be used as intended for the purpose of hydraulically cracking open the grout body surrounding the tube section in the region of this injection valve after the initial introduction of grout into the bore hole or to expand the volume according to the admission pressure of the grout suspension or of any other self-hardening medium. In any case, endeavours are subsequently made to expand the rock region which is penetrated by the grout suspension and which therefore provides a contribution to the connecting effect between the rock and the injection tube and/or to the compacting as well as stabilising of the rock. In this way, an anchoring effect comparable to a straddling dowel is achieved, which is capable of greatly expanding spatially in proportion to the admission pressure of the grout suspension as well as the structure of the surrounding rock. As soon as the further admission of grout suspension is ceased, a flow back into the longitudinal channel of the injection tube is prevented by means of this injection valve, so that the hardening process can subsequently start. Even in rock which has low cohesive properties, a reliable connecting effect between the injection tube and the rock is produced corresponding to the expansion which is achieved under the influence of the injection valve(s) of the region covered by the grout suspension. Accordingly, the injection tube can, in the simplest manner, be a tube which has a continuous profile on the outer side and is closed on the side towards the bore hole bottom and is equipped with at least one injection valve.

According to another feature of the present invention, the injection tube is constructed in the form of an injection bore anchor and is equipped on the side towards the bore hole bottom with a bore-crown. This application is substantially, however not exclusively, the subject matter of the invention.

A pre-condition for the use of injection valves, according to the above designs, is naturally that after initially filling the created bore hole with a grout suspension using the injection bore anchor located within the bore hole, the already existing outlet orifices of the bore head as well as the region of the anchor rod section near to the bore head can be blocked off. This can for example occur by the insertion of a displacement body, by inserting the displacement body into the longitudinal channel which displaces by way of the said outlet orifices the grout suspension still present in the longitudinal channel subsequently to the filling of the bore hole and conveying the grout suspension into the rock. This displacement body subsequently remains within the longitudinal channel and is inserted into the longitudinal channel to the extent that in each case the injection valves are uncovered on the inner side. In accordance with a further feature of the present invention, the injection tube has a valve associated with the outlet orifices of the bore-crown and of the region of the anchor head section in the proximity of the bore-crown, the said valve being inserted into the longitudinal channel and constructed in the form of a non-return valve. In the region adjacent to the bore bottom, there are therefore in accordance with the invention two valves and/or groups of valves, namely the injection valves already mentioned on the one side and on the other side the valves associated with the outlet orifices, among other things the bore-crown, wherein both valves differ mainly in their pre-stressing, as a result of which these valves never function simultaneously. The pre-stressing of the injection valves is therefore measured in such a way that they only open when there is sufficient pressure for the subsequent injection and not on the other hand under the pressure to which the flushing liquid is initially subjected during the boring operation and also the grout suspension introduced initially for the purpose of filling the bore hole. The valves associated with the bore-crown and/or the region in the proximity of the bore-crown are consequently to be dimensioned in such a way that they open at such a pressure, to which the flushing liquid and/or, the grout suspension, which is introduced initially, are subjected. It is therefore important that the two said groups of valves constantly open in sequence, namely during differing operating phases and therefore never simultaneously. It is also important to design the two types of valve in the form of non-return valves, which facilitates the flow of a free-flowing medium through these valves only in one direction, namely out of the longitudinal channel into the surrounding rock space.

According to still a further feature of the present invention, the injection valve is expediently arranged only in one region adjacent to the bore-crown. This can, for example, at the same time be a region starting at the bore-crown and extending up to 50% of the length of the anchor rod section adjacent to the bore-crown. In this way, it is ensured that in particular the region adjacent to the bore hole bottom experiences an expanding effect and therefore becomes more reliably attached in the surrounding rock.

It is, however, feasible in accordance with the invention, to provide a plurality of injection valves along the injection bore anchor, so that the anchorage effect can be improved over a greater spatial area. The injection valves are also in this case arranged preferably in such a longitudinal region which commences at the bore-crown and amounts to a maximum 50% of the total length of the injection bore anchor and/or of the anchor rod section(s). This can be determined individually in proportion to the existing structure of the rock layers to be connected.

The next features are directed at a design which is particularly simple and inexpensive to achieve for injection valves to be used, in particular non-return valves. These valves can be arranged optionally at points along the anchor rod sections. They comprise substantially of a hose section, comprising flexible material, which is pushed over the anchor rod section and in its final assembly position sealingly covers a transverse bore. The said stop rings protrude radially over the hose section and secure its axial position in particular during the boring operation.

Instead of one transverse bore, a plurality of transverse bores are provided evenly distributed on the periphery, in order to facilitate that the grout suspension flows out as evenly as possible. The hose section can particularly advantageously comprise fibre-reinforced rubber material or material of comparable elasticity, which in each case is to be dimensioned to the effect that during the initial filling of the bore hole, the valves remain non-operational, i.e. maintained in the closed condition. The injection valves only open when the admission pressure has increased, wherein it is a precondition that the outlet orifices of the bore head and other outlet orifices used for flushing purposes are previously closed by means of a closure body.

According to further features, a shut-off body is provided for each bore of the anchor rod section and/or the tube element of the injection valve and the said shut-off body is held by means of the enveloping body in a position which sealingly closes the bores. In this case, the enveloping body forms a readjusting spring which holds the shut-off body in the closed position. The shut-off body, as such, can fundamentally be of any design and is, for example, constructed as a sphere, cone, truncated cone etc. This design of an injection valve is to be regarded as particularly reliable and is in particular suitable for extremely high pressures.

Further features are directed at different variants, in that the shut-off body can be constructed separately from the enveloping body or together with the enveloping body as an associated and/or one-piece component.

Still further features are directed at further embodiments of the shut-off body as well as the bore cooperating with this said shut-off body. When a reinforced insert is used, the shut-off body is extremely rigid which can be of advantage with extremely high pressures. The bore has an inwardly tapering shape and the shut-off body is adapted to suit this design. In this way, when the pressure is reduced, the shut-off body can be more easily inserted into the bore.

The injection valve can be particularly advantageously designed as an intermediate element between two tube elements, wherein, for example, the cylindrical shaped anchor rods, assuming the function of stop rings, correspond, so that a central tube element, which protrudes on both sides beyond the tube cylinder, can be used as a screw-in end for coupling to an anchor rod end. This provides the advantage that the injection valve does not produce any structural elements which protrude out of the anchor rod, since the said enveloping body is designed practically flush with a tube cylinder and/or the stop rings. This comparatively "smooth" design of the anchor rods encourages a flushing fluid which is carrying rock particles to flow out during the bore operation.

According to the further features, the stop ring can be connected to the anchor rod section either by means of a screw connection or a weld.

In accordance with a further feature of the present invention, a method of placing a ground anchor is proposed, in accordance with which in a next step after filling an annular space between an inner side of the bore hole and the outer side of an anchor rod section, the grout suspension remaining within the longitudinal channel of the injection bore anchor is removed, wherein the injection valves are uncovered, and furthermore, in a still further step a cracking open effect is exerted in a hydraulic manner by way of the at least one injection valve on the grout enveloping the anchor rod section and the ground suspension is pressed into the existing gaps, cracks or the like. Accordingly, after the grout suspension has been initially introduced by way of the longitudinal channel of the injection bore anchor located in the bore hole, this longitudinal channel is relieved of the grout suspension still located in the longitudinal channel and in fact at least to the extent that the injection valves are uncovered radially on the inner side. Moreover, it is necessary by reason of the final position of the displacement body that all conventional outlet orifices are closed in a suitable manner. Subsequently, i.e. at the earliest time after an initial setting and/or an initial hardening of the grout surrounding the anchor rod section, the grout is cracked open hydraulically. This process can be carried out by introducing a fluid medium such as for example water, however also by means of a grout suspension. The prevailing pressure within the longitudinal channel during the flushing process and/or the initial introduction of the grout amounts to less than 15 bar, whereas a pressure of more than 15 bar, particularly 60 bar to 100 bar is required subsequently to crack open the grout. As a result of this, the flexibility of the hose section of the said injection valves is dimensioned to this effect since these valves only open in the case of an increased admission pressure which is required to crack open the grout, but below this pressure on the other hand they remain in the closed position. On completion of cracking open the grout, grout suspension can subsequently be introduced into the gaps and cracks formed in this manner and furthermore the grout suspension can be introduced into the surrounding rocks. As a consequence of the grout suspension penetrating the rock, the rock loosens corresponding to the extent that the rock is held together, so that the region penetrated by the grout and the surrounding layers of rock expand. The result of this is that, after the grout has hardened, an expanded anchoring region is formed, the said anchoring region penetrates deeply into the surrounding rock and forms a reliable anchorage for the ground anchor.

The grout suspension remaining in the longitudinal channel after the initial filling of the bore hole can be removed in different ways. First of all, it is possible by means of a displacement body inserted in the longitudinal channel to produce a displacement effect on the still fluid grout suspension and this said grout suspension can be displaced out into the surrounding rock by way of the outlet orifices located in the region of the bore head. This displacement body subsequently remains in the longitudinal channel and in fact in such a position that all the outlet orifices of the bore head and/or of the region of the anchor rod section in the proximity of the bore head are closed. The displacement body in conjunction with these outlet orifices therefore functions as a valve and is expediently designed in such a way that upon a movement in the direction towards the end of the injection bore anchor lying remote from the bore head, it produces a shut-off effect together with the walls of the longitudinal channel, thus producing a self-locking process. Moreover, the end position of the displacement body within the longitudinal channel is determined in such a way that the said injection valves are uncovered radially on the inner side. For the purpose of completely removing the remaining grout suspension still located within the longitudinal channel, the said channel is expediently flushed out. Instead of subsequently inserting a displacement body, it is possible to also provide a valve in the region of the bore-crown and in fact within the longitudinal channel, the said valve being designed in the form of a non-return valve and being mounted in advance of the outlet orifices of the bore head used for flushing purposes. This pre-stressed valve is designed in such a way, that it opens in the case of a pressure under which, during the boring operation, the flushing fluid flows and, during the initial filling operation of the bore hole, the grout suspension flows. This pressure is such that the injection valves remain in the closed condition. When using such a valve, the grout suspension still remaining within the longitudinal channel after the initial filling of the bore hole, is removed exclusively by flushing, wherein this valve remains in the closed condition, this process requires a correspondingly low pressure of the flushing medium.

The process of hydraulically cracking open the hardened grout or other media more than once can also be used correspondingly in the case of injection tubes which mainly serve to reinforce rock by means of introducing grout.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
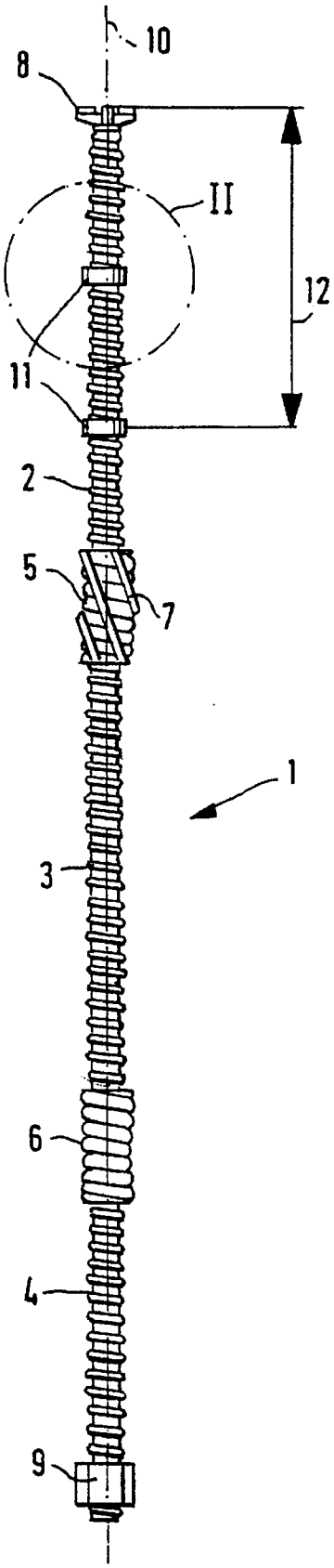
FIG. 1 is a schematic illustration of a lateral view of an injection anchor in accordance with the invention.

The designation 1 in FIG. 1 refers to an injection bore anchor and/or a so-called self-boring injection anchor which is formed in the embodiment illustrated by the anchor rod sections 2, 3 and 4. In the manner known per se, each anchor rod section is covered on the outside over its entire length by an annular thread, among other things this said annular thread serves to improve positive locking with a grout which otherwise fills the bore hole and/or with any other hardening media, e.g. artificial resin.

The designations 5, 6 refer to connecting sleeves into which the ends of the anchor rod sections lying opposite each other are screwed in and by means of which the holding together of the anchor rod sections is guaranteed. The connecting sleeves are bodies of a tubular design which are shaped on the inner and outer sides in the form of a thread and the connecting sleeve 5 is equipped with a plurality of spacers 7 in the form of iron rod welded on the outer side. The designation 8 refers to a plate-shaped bore-crown which clearly overhangs the diameter of the anchor rod section 2 and which is fitted with transverse cutters on the side towards the bore hole bottom, the said bore-crown being welded to the anchor rod section 2.

The designation 9 finally refers to a restraining nut intended for the purpose of screwing on to the end of the anchor rod section 4 as well as for cooperating with an anchor plate known per se (not illustrated).

The anchor rod sections 2, 3 and 4 as well as the bore-crown 8 comprise a central continuous longitudinal channel extending in the direction of the axis 10 and further continuous transverse channels can branch off from this said longitudinal channel in the region of the bore head. Fundamentally, transverse channels can also be provided in the region of the anchor rod section 2 in the proximity of the bore head. During the production of the bore, the said channel as well as the transverse bores serve in a manner known per se to guide a flushing medium and after the bore is produced, they serve in a manner known per se to introduce a grout suspension, a resin or another comparable self-hardening medium which is suitable for producing a connection between on the one side the injection anchor 1 and on the other side the surrounding bore hole walls.

In the illustrated embodiment, the front anchor rod section 2 which supports the bore-crown 8 is equipped with two injection valves 11 which are both of the same design. These injection valves 11 are attached along a region 12, which starting from the bore-crown 8 amounts to a maximum of 50% of the entire length of the injection bore anchor. The injection valves 11 which are both of the same design are formed in such a way that the said injection valves enable the media to flow through under pressure starting from the longitudinal channel of the bore rod section 2 in the radially outwards direction, but in the opposite direction, directed namely radially inwards, function as non-return valves.

Figure 2:
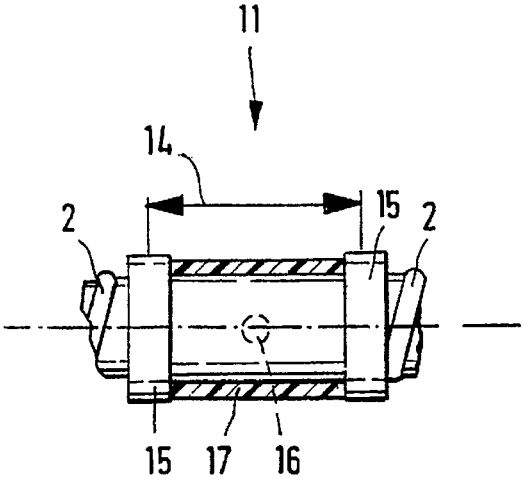
FIG. 2 is a partially open illustration of a detailed illustration of the detail II of FIG. 1.

For the purpose of explaining a possible structural design of such an injection valve 11, reference is made hereinunder to the illustration in FIG. 2:

The anchor rod section 2 is provided with stop rings 15 at the point of the injection valve 11 and the said stop rings 15 are pushed onto the anchor rod section and welded to the said section while allowing a spacing 14. However, a screw connection could also be considered.

A transverse bore 16 is located within the spacing 14 between the stop rings 15 and in fact preferably in the centre section between the stop rings 15. Likewise, a plurality of transverse bores 16 of this type are preferably provided distributed evenly on the periphery. These transverse bores form a continuous connection to the said longitudinal channel and the importance and function of these transverse bores is explained further hereinunder.

The designation 17 refers to a hose section which sealingly surrounds the anchor rod section 2 and which comprises a flexible material, for example rubber, the said hose section extends between the stop rings 15 by means of which its axial position is secured. The thickness of the hose element 17, which expediently comprises a fibre reinforced rubber, is dimensioned in such a way that the said hose element runs substantially flush to the stop rings 15. The system comprising stop rings 15 and hose section 17 forms an injection valve, which functions in the way of a non-return valve and its method of functioning is explained further hereinunder.

The injection bore anchor illustrated in the drawings is intended for use in particularly friable rock which has low cohesive properties and it is used for the purpose of placing initially as a bore rod. During the boring operation, a suitable flushing medium, e.g. water, flows through the longitudinal channel of the bore rod and the said flushing medium exits through the central flushing bore of the bore-crown 8 and if need be exits through the further flushing bores provided in this region. Subsequently the said flushing medium takes up the rock material released by means of the transverse cutters of the bore-crown 8 and flows out between the inner side of the formed bore hole and the outer side of the anchor rod sections 2, 3, 4 in a backward direction towards the bore hole outlet. In so doing, the displacement process is supported by means of the thread-type shape extending over the entire length of the injection bore anchor, including the connecting sleeves 5, 6. According to the length of the bore hole and of the bore continuation, the bore rods are extended using connecting sleeves 5, 6 and further anchor rod sections 3, 4 until the final depth of the bore hole is attained. Subsequently, a self-hardening medium, for example a grout suspension, is introduced by way of the said longitudinal channel and the said self-hardening medium for its part exits in the region of the bore head by way of the said flushing bores. In so doing, the said flushing medium partially penetrates the surrounding rock and partially flows along the outer side of the injection anchor in the direction of the bore hole outlet and fills the hollow space existing here. During the flushing process and the filling of the said hollow space, the flushing fluid and/or the grout suspension within the longitudinal channel of the anchor rod sections 2, 3, 4 are subjected to a pressure of less than 15 bar i.e. such a pressure that the injection valves 11 remain in each case in the closed condition. After completing this first phase of placing the anchor, the remaining residue of grout suspension in the central channel is displaced, by means of introducing a displacement body, the structure of which is still to be explained hereinunder, in the central channel of the anchor, in that the said displacement body is moved within the injection anchor in the direction of the bore-crown 8. The displacement body is in any case pushed into such a region of the injection anchor 1, which is lying between the bore-crown 8 and the furthermost injection valve 11 at the front. It is furthermore important for the final position of the displacement body, that all the normal flushing bores are closed by means of the displacement body, so that the longitudinal channel forms a sealed space during this operational phase. After having introduced the displacement body, it is particularly expedient to use a flushing medium to flush out if necessary any grout suspension in the longitudinal channel.

Subsequently and in fact after an initial setting of the grout suspension, for example after at least six hours, a grout suspension is re-introduced under pressure into the injection anchor 1 by way of the longitudinal channel. This said grout suspension now exits by way of the transverse bores 16 of the injection valve 11 and in so doing correspondingly flexibly expands the hose section 17. The exiting grout suspension exerts a cracking effect on the grout already located in the bore hole in this region and/or the said grout suspension penetrates the gaps formed in this way so that as a result of the grout exiting in the region of the injection valves, the existing region already penetrated by the grout and possibly released rock portions is expanded and/or enlarged. This causes a considerable expanding effect on the structure of the entire system, comprising grout and ground anchor and consequently contributes to the further securing of the position of the injection bore anchor 1 in the bore hole.

Alternatively, the grout can also be cracked open with a flushing fluid, e.g. water, so that a grout suspension is only subsequently introduced.

Particularly in the case of downwards and/or diagonally downwards orientated bore holes it is possible, after filling the bore hole and introducing the displacement body and subsequently flushing the longitudinal channel, to leave the remaining flushing fluid within the said longitudinal channel, so that a subsequent hydraulic cracking open of the grout surrounding the injection bore anchor within the bore hole can be carried out by means of a grout suspension with an intermediate arrangement of the fluid column which comprises flushing fluid and is located within the longitudinal channel.

If the expanding process in the aforementioned sense is complete and/or the admission pressure of the grout suspension within the injection anchor 1 is reduced, then the grout is prevented from flowing back into the injection bore anchor 1 by means of the flexibility of the hose sections 17, so that the injection valves to this extent function as non-return valves.

If necessary, the aforementioned expanding process can be repeated on more than one occasion. Whether the expanding process is to be repeated, depends on the result of the measurement, carried out according to the known method, of the capability of the ground anchor to absorb the tensile load. For this purpose, the residue of grout suspension still located in the longitudinal channel is flushed out after an initial expanding process and in fact directly following the closing of the injection valves 11. This can, for example, be carried out by means of a hose, which is introduced into the longitudinal channel, whose flushing fluid, e.g. water, absorbs the grout suspension and flows out. In this way, the longitudinal channel is uncovered as far as the said displacement body, i.e. including the injection valves 11. Subsequently, i.e. after at least an initial setting of the grout suspension, the step already illustrated above of the expanding process is repeated, i.e. the grout surrounding the anchor rod section is hydraulically cracked open, in order to subsequently introduce further grout suspension into the bore hole.

The injection valves 11 can also be used as outlet orifices for the grout suspension to the same extent during the first introduction of the grout suspension.

In order to attain a particularly reliable sealing effect of the injection valve 11, it is possible to design the injection valve 11 in such a way that the hose section 17 envelops an inner hose formed from a relatively soft, preferably rubber-type material, the said inner hose being suitable for cooperating in a sealing manner with the outer thread of the anchor rod section 2 and being radially supported by means of the outer hose section 17. Alternatively to the arrangement of an inner hose, the outer thread cooperating with the hose section 17 can also be made smooth by applying a suitable mass, one possible method would be to vulcanise a rubber material onto the said outer thread. A comparable effect is achieved if, at the points of the anchor rod section 2 which serve to attach the injection valves 11, the wall is smooth and without thread-type formations on the surface.

The method in accordance with the invention, with respect to the injection bore anchor serving to carry out this method, leads in the end result, by reason of the expanding effect exerted on the bore hole walls, to the anchor sitting particularly securely, especially with rock which has low cohesive properties.

Figure 3:
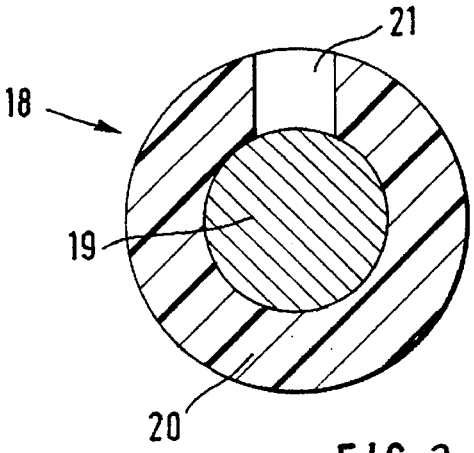
FIG. 3 is a first embodiment of a displacement body.
Figure 4:
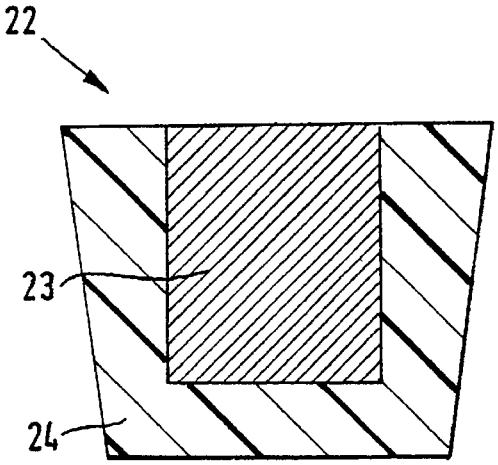
FIG. 4 is a second embodiment of a displacement body.

FIGS. 3 and 4 merely illustrate examples of possible designs of a displacement body intended for use with the injection anchor. In this way, FIG. 3 illustrates a displacement body 18 which is substantially spherical and comprises a metallic core 19, the said core, for its part, being enveloped by a sheath 20 comprising flexible material. The displacement body is dimensioned in such a way that the said displacement body can only be displaced within the central channel by flexibly reshaping the sheath 20, which causes a considerable amount of frictional contact with the inner walls of the anchor rod sections. A bore 21 which penetrates the sheath 20 serves to alleviate the displacement of the displacement body 18 by means of a rod which directly influences the metallic core 19.

FIG. 4 illustrates a displacement body 22 which includes a metallic cylindrical core 23 and a rotationally symmetrical sheath 24 which conically envelops the said core 23, the said sheath 24 comprising again a flexible, deformable, synthetic material. With respect to the dimensions, the same applies as to those of FIG. 3.

Numerous variations of displacement bodies are imaginable, in particular they can also be equipped on the outer side, with brushes, ribs or similar, which particularly in the rearwards direction produce a shut-off effect in connection with the inner side of the longitudinal channel. Instead of pairing metal-synthetic materials, it is also possible to pair hard and soft synthetic materials.

Figure 5:
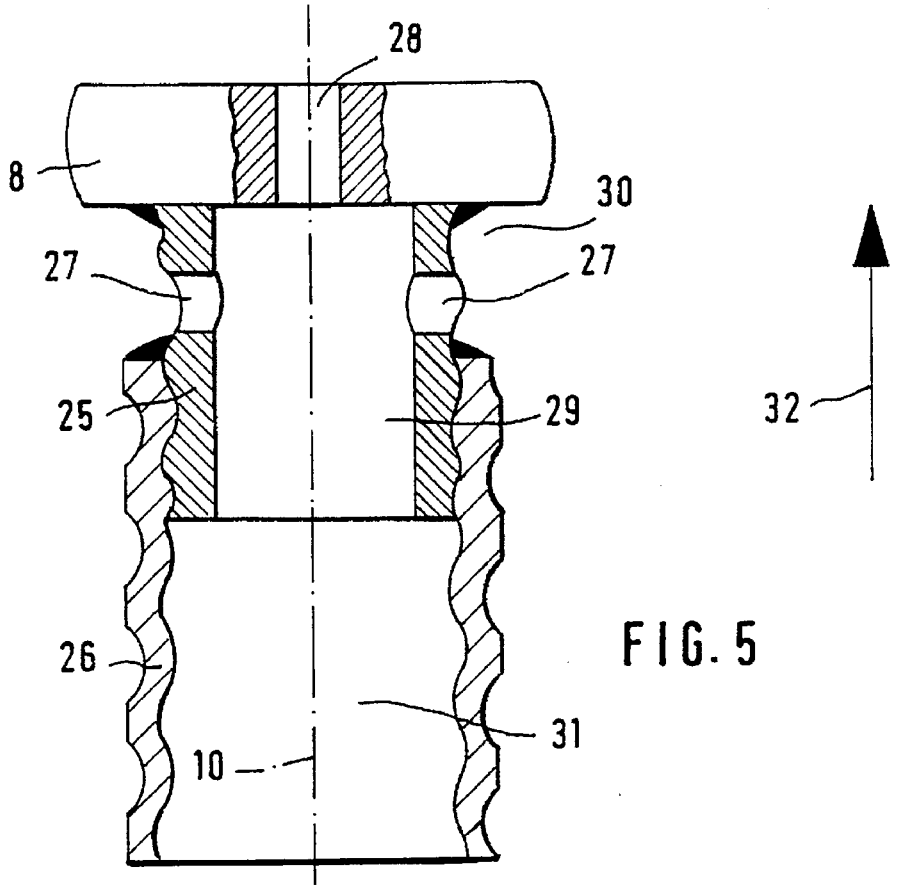
FIG. 5 is a sectional illustration of a region of the injection bore anchor adjacent to the bore head.

FIG. 5 illustrates a possible design of the region adjacent to the bore head 8. The designation 25 refers here to a comparable short part of an anchor rod section, which is welded to the plate-shaped bore-crown 8 which is fitted with transverse cutters (not further illustrated). The anchor rod section 25 is for its part screwed into a connecting sleeve 26 and additionally welded to said connecting sleeve. The designation 28 refers to a central flushing bore of the bore head 8 running in the direction of the axis 10.

The connecting sleeve 26 is screwed to the anchor rod section 25 in such a way that a flushing medium or also a grout suspension can exit in an unhindered manner by way of radially orientated flushing bores 27. Moreover, the connecting sleeve 26 serves in a manner known per se to allow the inner side screw connection to further anchor rod sections.

In accordance with the invention, a displacement body to be used in the sense of the above designs is to be dimensioned in such a way that the said displacement body can be introduced in to the cross section 29 of the anchor rod section 25 in such a way that all flushing bores 27, 28 are closed.

The illustrated embodiment of the region adjacent to the bore-crown 8 is extremely advantageous even from the point of view of technical aspects relating to the boring operation and/or to the flow, since a relatively large undercut 30 is produced directly behind the bore-crown 8 and this has a favourable effect when carrying away the rock materials released during the boring process.

However, as a deviation from the above embodiments, it is also sufficient for the function of the displacement bodies 18, 22 if they can be fixed in a frictionally engaged manner in a region 31 of the connecting sleeve 26, which is mounted in advance of all flushing bores 27, 28 in the direction of the flow, characterised by the arrow 32, of a flushing medium, since fundamentally in particular the flushing bores 27 formed as radial bores can be provided in a region in the proximity of the bore head and therefore also in the connecting sleeve 26. The important fact in this case is merely that a valve function is executed in this respect by means of introducing the displacement body as all the said flushing bores can be closed by means of the said displacement body.

Figure 6:
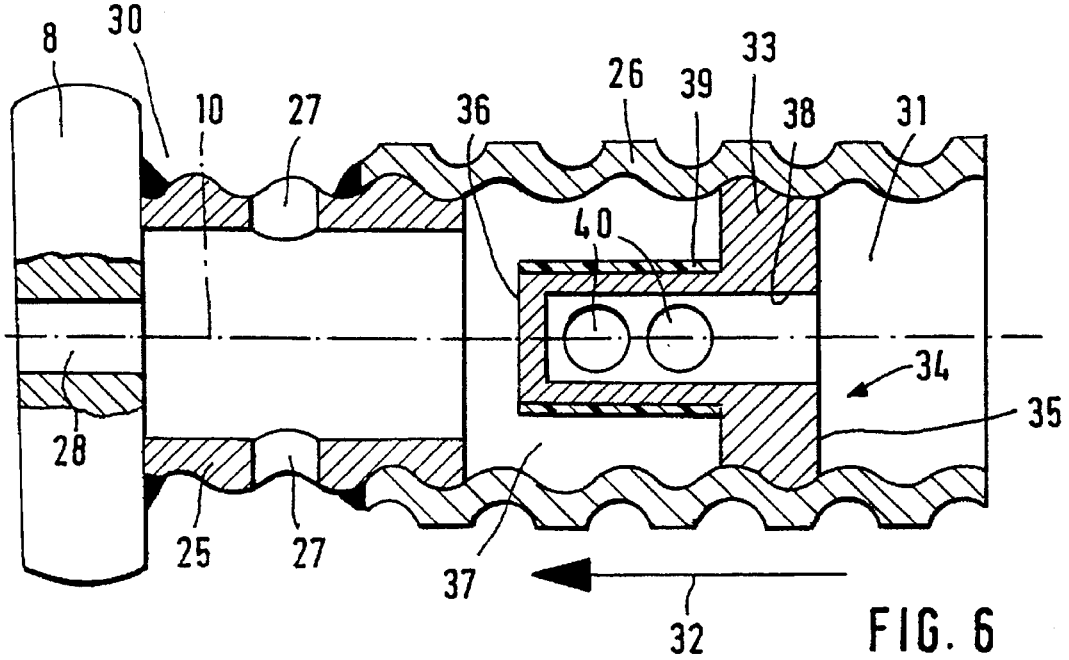
FIG. 6 is a sectional illustration of another embodiment of a region of an injection anchor adjacent to the bore head.

The embodiment illustrated in FIG. 6 of the region of the injection bore anchor in the proximity of the bore head is modified to the effect that the function of the shut-off body 18, 22 has now been replaced by means of a fixedly installed valve 33 which fulfils the function of the non-return valve. This valve is, as is described in more detail hereinunder, designed in such a way that a flow in the direction of the arrow 32 is rendered possible but on the other hand a flow in the opposite direction to arrow 32 is blocked. Insofar as a valve is suitable for fulfilling these functions, then fundamentally any valve can be used here, even if it is of a different structural design.

The valve 33 comprises a valve body 34 which, for its part, comprises a head part 35 intended for providing to a greatest extent a sealing screw connection with the inner side of the sleeve part 26 on the one hand and comprises on the other hand an extension piece 36 which is smooth on the outer side and is formed as one piece with head piece 35. The extension piece 36 is of a considerably smaller radius than the head piece 35, so that an annular space 37 is produced in order to envelop the extension piece 36.

The valve body 34 includes a central bore 38 extending coaxially to the axis 10 and this said bore 38 is closed on its front end facing the bore-crown 8.

The designation 39 refers to a hose section which is formed from a flexible material, for example a rubber-flexible material. The said hose section sealingly envelops the extension piece. 36 which is of a rotationally symmetrical design and in the unstressed condition, the said hose section seals the transverse bores 40 which are located in the extension piece 36 and which issue into the bore 38.

It is important that the hose section 39 is designed by means of dimensioning its thickness and/or expediently selecting the material, in such a way that its flexibility is substantially greater than that of the hose section 17, so that consequently the valve 33 renders a flow in the direction of the arrow 32 possible when subjected to pressures under which the injection valves 11 remain in the closed condition.

As already mentioned in the introduction, these pressures are for example less than 15 bar.

An injection bore rod fitted out along the lines of FIG. 6, is used as follows:

First of all, the injection anchor is used in a manner known per se as a bore rod by way of a flushing medium flowing in the direction of the arrow. 32 wherein the flushing medium flows by way of the valve 33 and exits by way of the flushing bores 27, 28. After producing the bore hole, the grout suspension or another self-hardening medium is guided in a manner known per se in the direction of the arrow 32 and the said self-hardening medium, according to its pressure likewise flows exclusively by way of the valve 33 and not by way of the injection valves 11, i.e. it exits in the region of the flushing bores 27, 28 and starting from the bore hole bottom fills the entire bore hole.

Finally and by means of a lower pressure, the grout suspension remaining within the injection bore anchor 3 is flushed out, wherein now by reason of the grout suspension exerting pressure on the outer side of the hose section 39, the valve 33 prevents a further flow in the direction of the arrow 32, whereas on the other hand the inner space of the injection bore anchor is flushed out as far as the valve 33. Moreover, this flushing pressure is dimensioned to such an extent that the valve 33 does not open in any circumstances. Particularly with the downwards and/or diagonally downwards running pore holes, the flushing fluid filling the injection bore anchor can remain in the injection bore anchor, wherein after the grout has hardened, this fluid can be used as a hydraulic means for cracking open the grout surrounding the bore anchor by means of the injection valves 11. The fluid column remaining within the bore anchor is therefore used for the cracking open process by means of the grout adjoining the fluid column, wherein the grout finally exits by way of the injection valve 11 and the effect already mentioned above is produced.

This embodiment can naturally also be used in such a way that after the injection bore anchor has been flushed out, the grout is cracked open directly by means of a grout suspension.

With reference to the above embodiments, it is evident that the injection bore anchor, in accordance with the invention, is substantially characterised by means of two valves and/or valve groups, namely a first valve 33 associated with the bore head, the said valve 33 serving the flushing out as well as the initial filling of the bore hole and already opening under a comparatively low pressure, i.e. a flow in the direction of arrow 32 is rendered possible. This first valve is, however, without a function after the filling and the hardening of the grout suspension and consequently functions as a shut-off body which prevents any further flow by way of the said flush bores. Moreover, during the flow of flushing medium and of the initial grout suspension, this first valve functions as a non-return valve, i.e. it prevents a return flow in the opposite direction to the arrow 32. The said second valve and/or the group of valves used here are the injection valves, which are mounted in advance of the first valve in the direction of the arrow 32 and which serve to control the flow by way of radial bores and/or transverse bores 16. A plurality of these injection valves can naturally be provided and these injection valves are also designed according to the form of non-return valves, whose characterising feature exists however in the fact that in the return from the first mentioned valve they open at a substantially higher pressure which exists within the injection bore anchor and which is greater than 15 bar, for example between 50 bar and 100 bar. During the flushing out as well as during the initial filling of the bore hole, these injection valves are, as already mentioned above, completely without a function by reason of their high opening pressure, i.e. they are located in the closed condition during this phase. Moreover, it is evident from these embodiments that both valves and/or valve groups can be regarded, seen from the flow direction, as resiliently pre-stressed valves and each valve is pre-stressed to a different amount. As a result of this, it is also possible to use here any structural modifications of valves, which correspond functionally to the pre-stressed valves illustrated.

Figure 7:
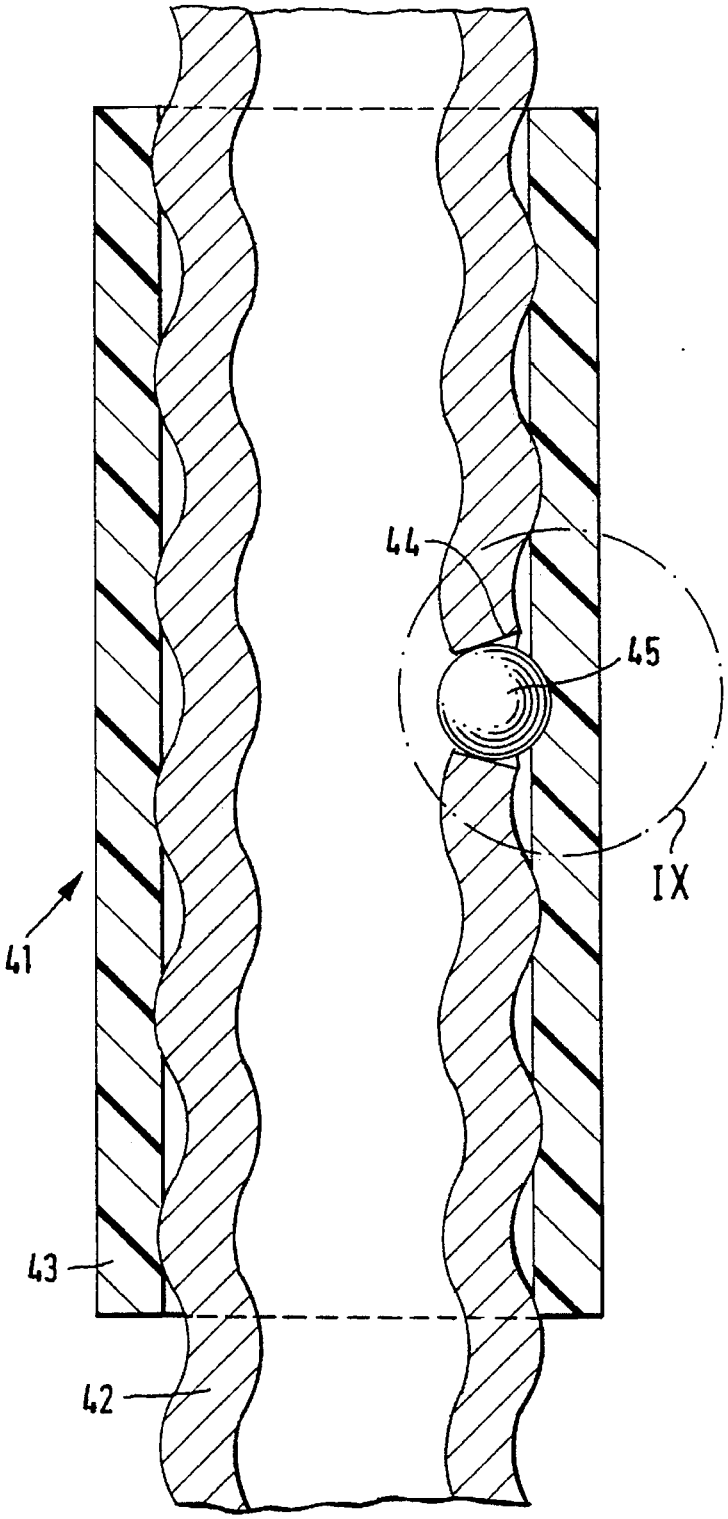
FIG. 7 is a sectional illustration of the substantial parts of a preferred embodiment of an injection valve.

The designation 41 in FIG. 7 refers to the variant of an injection valve, which comprises a tube element 42 which is provided with an outer thread and also comprises a hose-type enveloping body 43 which envelops coaxially this tube element 42. The tube element 42 can be directly a part of an anchor rod, it can however also be an intermediate element designed and intended for installation between two anchor rod sections. The enveloping body comprises a flexible, preferably rubber-flexible material, which again, if need be, can be fibre reinforced.

The designation 44 refers to a bore, which is conically tapered radially inwards of the tube element and a spherical shut-off body 45, is inserted into the said bore, held by means of the enveloping body 43. It is evident that a spring-loaded non-return valve is formed by the shut-off body 45 in conjunction with the enveloping body 43 which flexibly presses the shut-off body 45 flexibly into the bore 44 from the outer side of the tube element 42. The resilient characteristic of this injection valve 41 is produced by means of correspondingly dimensioning and/or designing the enveloping body 43 to the effect that the shut-off body 45 is only displaced in a radially outwards direction from the bore 44 against the flexible readjusting force of the enveloping body 43, and a flow is rendered possible out into the outer space when the pressure is increased, the said pressure being necessary for the purpose of subsequently cracking open a hardening grout body which envelops the anchor rod on the outside and eventually remains without a function, i.e. continues to remain in the closed condition.

The shut-off body 45 can comprise metal, e.g. steel. It can, however, also be formed from a suitable synthetic material. Also, the spherical shape of the shut-off body is not compulsory and in the same way it is also possible to use a conically shaped body for this purpose.

Stop rings (not illustrated in FIG. 7) can again be provided for the purpose of axially securing the enveloping body 43 and the said stop rings are screwed onto the outer side of the tube element 42 and extend on the outer side substantially flush to the enveloping body 43. The final assembled position of these stop rings can also be secured by welding to the tube element 42.

Moreover, the injection valve 41 produced along the above lines can be used in the same manner as the injection valve described in FIG. 2.

The variant of an injection valve 46 illustrated in FIG. 8 is again characterised by a central tube element 47, which is formed in the same way as the tube element 42 according to FIG. 7. As a deviation from the tube element 42, the tube element 47 is, however, characterised by four bores 48 which are of equal size and are arranged along a peripheral line, the said bores again being of a design which tapers radially inwards. In the same manner as with the embodiment illustrated in FIG. 7, each bore hole 48 is associated with a shut-off body (not illustrated) which is flexibly held in the bore by means of an enveloping body 50. Alternatively, the bores 48 can also be arranged in different peripheral angle positions to each other. However, bearing in mind the stability of the tube element 42, the bores 48 should not be arranged in a common cross-sectional plane.

The designations 51, 52 refer to tube cylinders which are provided on the inner side and outer side with a thread and the said tube cylinders are screwed onto the tube element on both sides of the enveloping body 50 and in this respect assume the function of stop rings. If need be, the tube cylinders 51, 52 can be secured in the final screw connection position by means of being welded to the tube element 47.

Figure 8:
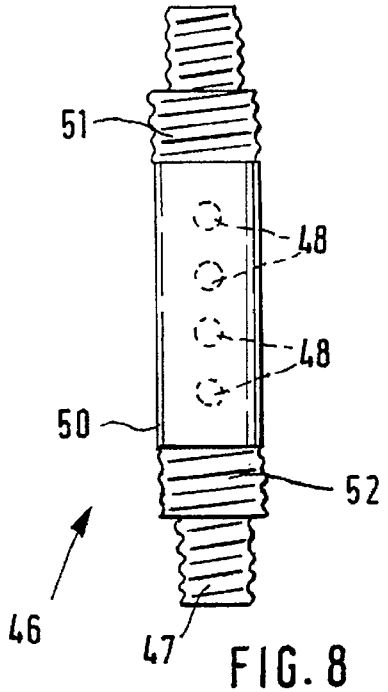
FIG. 8 is a view of a different embodiment of an injection valve.

At the same time, the tube element 47 can be part of an anchor rod, the injection valve 46 in the embodiment illustrated in FIG. 8, can, however, fundamentally be regarded as an intermediate element between two anchor rod ends.

If the tube element 47 is to be regarded as part of the anchor rod, then this tube element can be connected to another anchor rod end by using a conventional coupling sleeve.

It is, however, possible to regard the ends of the tube element 47 protruding out of the tube cylinders 51, 52 as screw-in ends, which are screwed into an opposite lying anchor rod ends, the said opposite lying end having radial dimensions and an outer thread which correspond to the tube cylinders 51, 52. In this case, the tube cylinders 51, 52 can be regarded as part of an anchor rod and in this case an anchor rod is produced which does not have any structural elements applied to the outer Side in the region of the injection valve.

Figure 9:
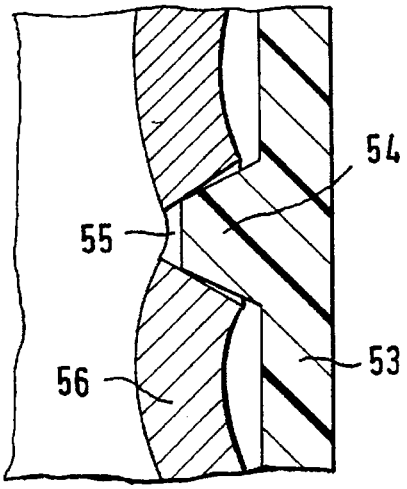
FIG. 9 is an illustration of a variant of a detail IX of FIG. 7.

FIG. 9 illustrates an enveloping body 53 which is formed as one piece with a shut-off body 54 which is approximately a conical shape.

The shut-off body 54 in turn protrudes into a bore 55 of a tube element 56 which corresponds to the tube elements 42, 47 and the said shut-off body 54 is held flexibly and prestressed in this position. It is also possible with this design variant of the shut-off body to provide a plurality of such shut-off bodies in a configuration which corresponds for example to that of FIG. 8.

The enveloping body 53 comprises again a flexible synthetic material which if necessary is reinforced by means of fabric inserts, for example a rubber-type synthetic material and the thickness of the said enveloping body 53 is designed with respect to the above-described function of an injection valve.

The conical shape of the shut-off body 54 is adapted to suit the conical shape of the bore 55, the said shut-off body can, however, also be of a hemispherical shape.

In the embodiment according to FIG. 9, the shut-off body 54 is designed from the same material as the enveloping body 53. In order to increase the rigidity of the shut-off body 54, a reinforcing body can be incorporated in the flexible material, for example in the form of a sphere or also a hemisphere.

A injection valve designed along the lines of FIGS. 7 to 9 is particularly suitable for high pressures, in particular, when several grout injection processes are to be carried out sequentially.

It will be understood that each of the elements described above, or two or more together, may also find a useful application in other types of methods and constructions differing from the types described above.

While the invention has been illustrated and described as embodied in an injection tube and method for placing a ground anchor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An injection tube, comprising at least one tube section provided with a continuously profiled contour and a central longitudinal channel; at least one injection valve provided in said tube section and rendering a flow from said longitudinal channel possible, said injection valve being formed as a non-return valve which impedes a return flow in direction of said longitudinal channel, said injection valve having a tube element provided with at least one bore and an outer element which sealingly envelops said tube element; and securing means provided axially on both sides of said outer element for axially securing its position, said securing means including coaxial stop rings.

2. An injection tube as defined in claim 1, wherein said stop rings and parts of said anchor rod sections which are connected to said stop ring are non-releasably connected to each other.

3. An injection tube as defined in claim 2; and further comprising means for connecting said stop rings and said part and including a welded connection.

4. An injection tube as defined in claim 1; wherein said stop rings are screwed to parts of said anchor rod section.

5. An injection tube, comprising at least one tube section provided with a continuously profiled contour and a central longitudinal channel; at least one injection valve provided in said tube section and rendering a flow from said longitudinal channel possible, said injection valve being formed as a non-return valve which impedes a return flow in direction of said longitudinal channel, said injection valve having a tube element provided with at least one bore and an outer element which sealingly envelops said tube element; and a shut-off body arranged in said at least one bore and sealingly closing said bore, said outer element holding said shut-off body in a closed position.

6. An injection tube as defined in claim 5, wherein said shut-off body is formed as a separate part composed of a material selected from the group consisting of metal and synthetic material.

7. An injection tube as defined in claim 5, wherein said shut-off body is formed as a part of said outer element.

8. An injection tube as defined in claim 7, wherein said shut-off body is composed of a material which is homogeneous to a material of said outer element.

9. An injection tube as defined in claim 7, wherein said shut-off body is composed of a material which is homogeneous to a material of said outer element and in addition is provided with reinforcing inserts.

10. An injection tube as defined in claim 9, wherein said reinforcing inserts have a shape selected from the group consisting of a sphere, a hemisphere, a cone and a truncated cone.

11. An injection tube, comprising at least one tube section provided with a continuously profiled contour and a central longitudinal channel; at least one injection valve provided in said tube section and rendering a flow from said longitudinal channel possible, said injection valve being formed in a direction of said longitudinal channel, said tube sections being formed as an anchor rod section of an injection bore anchor having a bore-crown and at least one outlet orifice, said anchor rod section being provided with a continuous profile contour, said longitudinal channel being continuous in said bore-crown and issuing in said at least one outlet orifice; as to make possible a flow from said and at least one further valve associated with said outlet orifice of said bore-crown and a region of said anchor rod section in the proximity of said bore-crown, said further valve being formed as a non-return valve so as to make possible a flow into said longitudinal channel, said valve having a valve body arranged in said longitudinal channel in advance of said outlet orifice as seen in direction of the flow of a flushing medium.

12. An injection tube as defined in claim 11, wherein said valve has a head piece attachable to an inner side of said anchor rod section, and an extension piece sealingly enveloped by a hose section of a flexible material, said valve body having a longitudinal bore cooperating with transverse bores which are shut off by said hose section and said longitudinal bore being otherwise open only on a front face.

13. An injection tube as defined in claim 12, wherein said extension piece is formed of one piece with said head piece.

14. An injection tube as defined in claim 12, wherein said head piece is screwed into said anchor rod section, said valve body being rotationally symmetrical, said longitudinal bore extending in an axial direction of said tube section.

15. An injection tube as defined in claim 12, wherein said extension piece is radially dimensioned so that an annular space is formed between said extension piece and an inner side of said anchor rod section.

16. A method of placing a ground anchor using an injection bore anchor, comprising the steps of producing a bore hole using a suitable flushing medium in a first step; introducing a self-hardening medium in the bore hole through a longitudinal channel of an injection bore anchor and through outlet bores of the longitudinal channel so that the self-hardening medium fills to a greatest extent an annular space between an inner side of the bore hole and an outer side of an anchor rod section in a second step; after the filling of the annular space removing the self-hardening medium remaining within longitudinal channel with uncovering of an injection valve in the anchor rod section in a third step; and exerting a cracking open effect in a hydraulic manner by way of the injection valve on the self-hardening medium enveloping the anchor rod section, and pressing the self-hardening medium into existing gaps and cracks in a fourth step.

17. A method as defined in claim 16, wherein said removing of the self-hardening medium includes removing said medium from the longitudinal channel by a displacement body so as to displace the self-hardening medium through outlet orifices of a bore-crown of the injection bore anchor and also a region of the anchor rod section in the proximity of the bore-crown, and leaving the displacement body within the longitudinal channel.

18. A method as defined in claim 17; and further comprising the step of flushing out the longitudinal channel after the introduction of the displacement body with a flushing fluid.

19. A method as defined in claim 16, wherein said exerting a cracking open effect includes exerting the same on the self-hardening medium which surrounds the anchor rod section by introducing a suspension of the self-hardening medium and pressing the suspension into existing gaps and cracks.

20. A method as defined in claim 16, wherein said exerting a cracking open effect includes exerting the same on the self-hardening medium which surrounds the anchor rod section by introducing a flushing fluid and subsequently introducing a suspension of the self-hardening medium and pressing the latter into existing gaps and cracks.

21. A method as defined in claim 16; and further comprising the step of flushing out the suspension of the self-hardening medium in a fifth step after said fourth step; and thereafter hardening medium in a fifth step after said fourth step; and thereafter repeating said fourth step.

22. A method as defined in claim 21; and further comprising repeating said fifth and fourth steps at least once.

23. A method as defined in claim 22, wherein said flushing out with a flushing fluid includes remaining the flushing fluid within the longitudinal channel after completing the flushing out of the longitudinal channel with descending gradients and/or downward directed bore holes, said exerting a cracking open effect includes introducing the self-hardening medium with using an intermediate arrangement of an existing fluid column comprising the flushing fluid, by means of which a cracking open effect is produced.

24. An injection tube, comprising at least one tube section provided with a continuously profiled contour and a central longitudinal channel; at least one injection valve provided in said tube section and rendering a flow from said longitudinal channel possible, said injection valve being formed as a non-return valve which impedes a return flow in direction of said longitudinal channel, said injection valve having a tube element provided with at least one bore and an outer element which sealingly envelops said tube element, said outer element being formed as a hose section; and a further hose section composed of a soft rubber-type material and arranged inside said first mentioned hose section, said anchor rod section having an outer thread and said further hose section closely fitting in a sealing manner on said outer thread of said anchor rod section.

25. An injection tube, comprising at least one tube section provided with a continuously profiled contour and a central longitudinal channel; at least one injection valve provided in said tube section and rendering a flow from said longitudinal channel possible, said injection valve being formed as a non-return valve which impedes a return flow in direction of said longitudinal channel, said tube section being formed as an anchor rod section of an injection bore anchor having a bore-crown and at least one outlet orifice, said anchor rod section being provided with a continuous profile contour, said longitudinal channel being continuous in said bore-crown and issuing in said at least one outlet orifice, said continuous profile contour of said anchor rod section being formed as a thread; and at least one further valve associated with said outlet orifice of said bore-crown and a region of said anchor rod section in the proximity of said bore-crown, said further valve being formed as a non-return valve so as to make possible a flow from said longitudinal channel and to shut off a return flow into said longitudinal channel, said at least one injection valve and said at least one further valve being prestressed so that said injection valve opens at a higher pressure than said further valve.

26. A method of placing a ground anchor using an injection bore anchor, comprising the steps of producing a bore hole using a suitable flushing medium in a first step; introducing a self-hardening medium in the bore hole through a longitudinal channel of an injection bore anchor and through outlet bores of the longitudinal channel so that the self-hardening medium fills to a greatest extent an annular space between an inner side of the bore hole and an outer side of an anchor rod section in a second step; after the filling of the annular space removing the self-hardening medium remaining within longitudinal channel with uncovering of an injection valve in the anchor rod section in a third step; and exerting a cracking open effect in a hydraulic manner by way of the injection valve on the self-hardening medium enveloping the anchor rod section, and pressing the self-hardening medium into existing gaps and cracks in a fourth step, said removing of self-hardening medium from the longitudinal channels with using the injection valve including flushing out the self-hardening medium with a flushing fluid.

* * * * *